United States Patent [19]

Pilao

[11] Patent Number: 4,624,420

[45] Date of Patent: Nov. 25, 1986

[54] REFINING DISC FOR WOOD PULP OR THE LIKE

[76] Inventor: Milton Pilao, Rua Manoel de Gois, 409, 05604 Sao Paulo, Brazil

[21] Appl. No.: 634,617

[22] Filed: Jul. 26, 1984

[30] Foreign Application Priority Data

Jul. 28, 1983 [BR] Brazil ..... 8304028

[51] Int. Cl.[4] ..... B02C 7/11

[52] U.S. Cl. ..... 241/298; 241/261.2

[58] Field of Search ..... 241/296, 297, 298, 261.2, 241/261.3, 285 R

[56] References Cited

U.S. PATENT DOCUMENTS 874,244 12/1907 Robinson ..... 241/296

4,157,669 6/1979 Pilao ..... 241/298 X

FOREIGN PATENT DOCUMENTS 7500262 5/1978 Brazil .

76167 7/1894 Fed. Rep. of Germany ..... 241/298

*Primary Examiner*—Mark Rosenbaum

*Attorney, Agent, or Firm*—Michael J. Striker

[57] ABSTRACT

A refining disc assembly for wood pulp or the like, particularly including a rotor disc and an intermediate disc of a coaxial assembly of three refining discs, comprises a hub having two or more radial peripheral fins, interconnected by an outer ring having spaced perforations for attachment thereto of a refining disc. The refining disc is formed of a carbon-steel, iron or stainless-steel frame and comprises two concentric rings, interconnected by radial rods. The internal ring contains perforations matching those of the hub. The refining disc receives on both faces thereof, a plurality of trapezoidal stainless-steel plates, attached thereto by welding, and with intermediate gaps which are filled with weld beads, the internal and external contours thereof being machined on a lathe, after which both faces of the so-obtained disc receive refining blades, attached by welding.

6 Claims, 6 Drawing Figures

REFINING DISC FOR WOOD PULP OR THE LIKE

BACKGROUND OF THE INVENTION

The object of Brazilian Pat. No. 7500262, of the same applicant, comprises a refining assembly for wood pulp or the like, the principal feature of which consists in the fact that the triturating work of the vegetable mass is done by the action of a coaxial assembly of three refining discs, of which the extremes are statically and respectively mounted on the cover and on an axially adjustable support inside the body of the unit, thus providing stator discs, the intermediate one, or rotor disc, being mounted on the hub of the control axle-shaft.

Further in regard to the refining discs, the first stator disc is provided with a centrally located opening surrounding the axle-shaft and fed directly by the vegetable pulp which enters the unit, the rotor disc being formed by a single, compact body, with a double refining surface, as well as provided with a central, multilobe opening, for material to pass, said rotor disc being integrally mounted on the axle-shaft hub, by means of internal radial lugs, projecting from the lobe formations on the central opening thereof and attachable to correspondingly radial and external fins provided on the referenced hub.

Notwithstanding all the positive characterization of the pulp-refining assembly of the above-mentioned patent, with a highly efficient job being performed by the coaxial assembly of the three refining discs provided therein, some improvements can still be presented, particularly in connection with the rotor disc, and principally as regards to the constructive characteristics thereof.

As a matter of fact, the cited rotor disc, such as set forth in the aforementioned patent, and on account of being comprised by a single and compact body, is subject to a certain amount of criticism related to a relatively high weight, as well as to an exaggerated use of material in the fabrication thereof and, further, to the fact that it requires a weld coat between the blades, the same being said as regards to the mounting hub thereof, which is also relatively heavy and with the internal lobe formations somewhat restricting a greater passage of mass.

SUMMARY OF THE INVENTION

In view of above circumstances and for the purpose of overcoming them, the improvements in a refining disc for wood pulp or the like, objects of the present invention, are now being proposed, such improvements to introduce a far more practical, efficient and rational constructive design for the rotor member, both for the refining disc in itself and for the mounting hub thereof, all for the purpose of obtaining greater perfection, regularity and high performance in the operation of the unit.

DETAILED DESCRIPTION OF THE PREFERRED EMBODIMENTS

The refining disc for wood pulp or the like, for which the improvements were designed, objects of the present invention, can naturally be applied to any assembly, but preferably like the rotor and intermediate locating disc in the coaxial assembly with three refining discs, already comprising the object of Brazilian Pat. No. 7500262, of the same Applicant.

Figure 1:
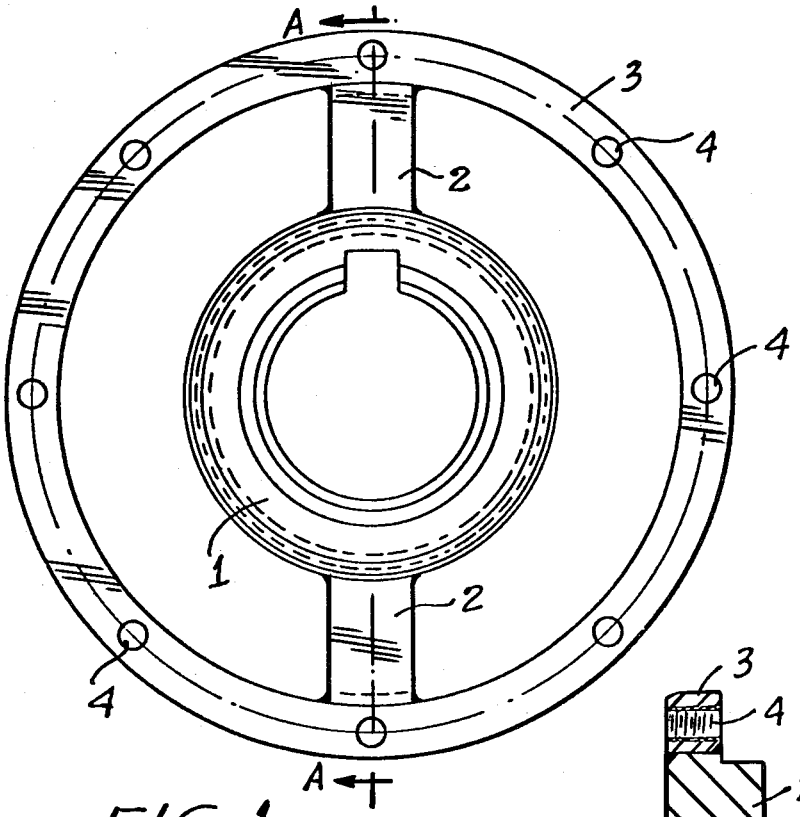
FIG. 1 is a lateral plane view of the improved hub of the unit's refining rotor assembly.
Figure 2:
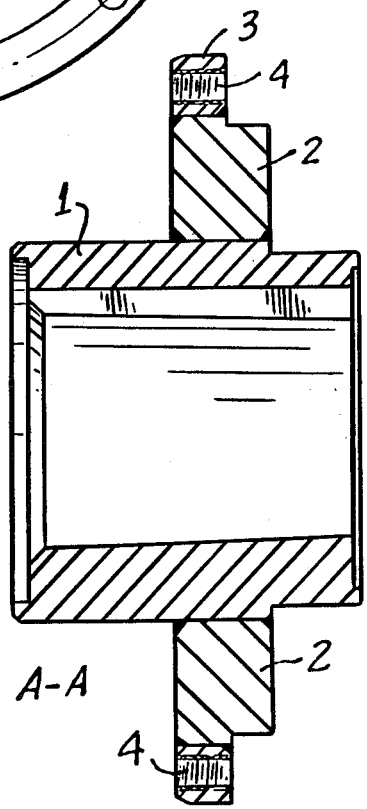
FIG. 2 is a diametral section through A—A, as indicated in FIG. 1.

Accordingly and in compliance with what is illustrated in the aforesaid figures, the improvements in a refining disc for wood pulp or the like, objects of the present invention, relate initially to the central hub 1 for mounting the rotor disc proper, such hub (FIGS. 1 and 2) from which two or more always diametrally opposed radial fins 2 extend, interconnected by a peripheral ring 3, with regularly spaced holes 4, for attachment to the strictly so-called refining disc.

It is this new constructive design for the central hub 1 which provides, as compared to the similar former designs, a larger central opening for the mass to pass through, as well as a substantial decrease in weight, to which it may be added that there is further a greater stability in the attachment of the refining disc in itself throughout the entire circumferential line of holes.

Figure 3:
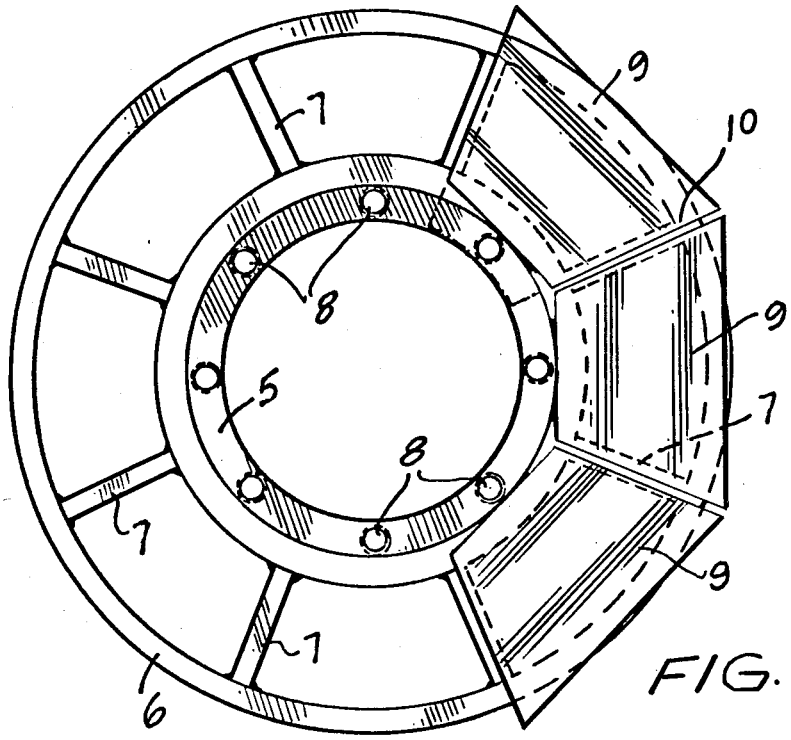
FIGS. 3, 4 and 5 are lateral views of the also improved rotor disc, in subsequent phases of its assembly.
Figure 4:
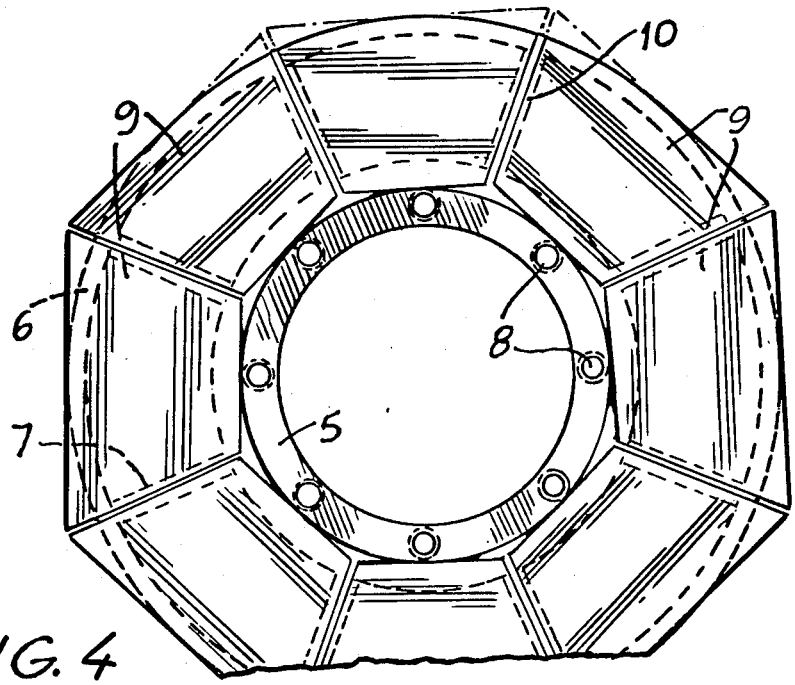
Figure 5:
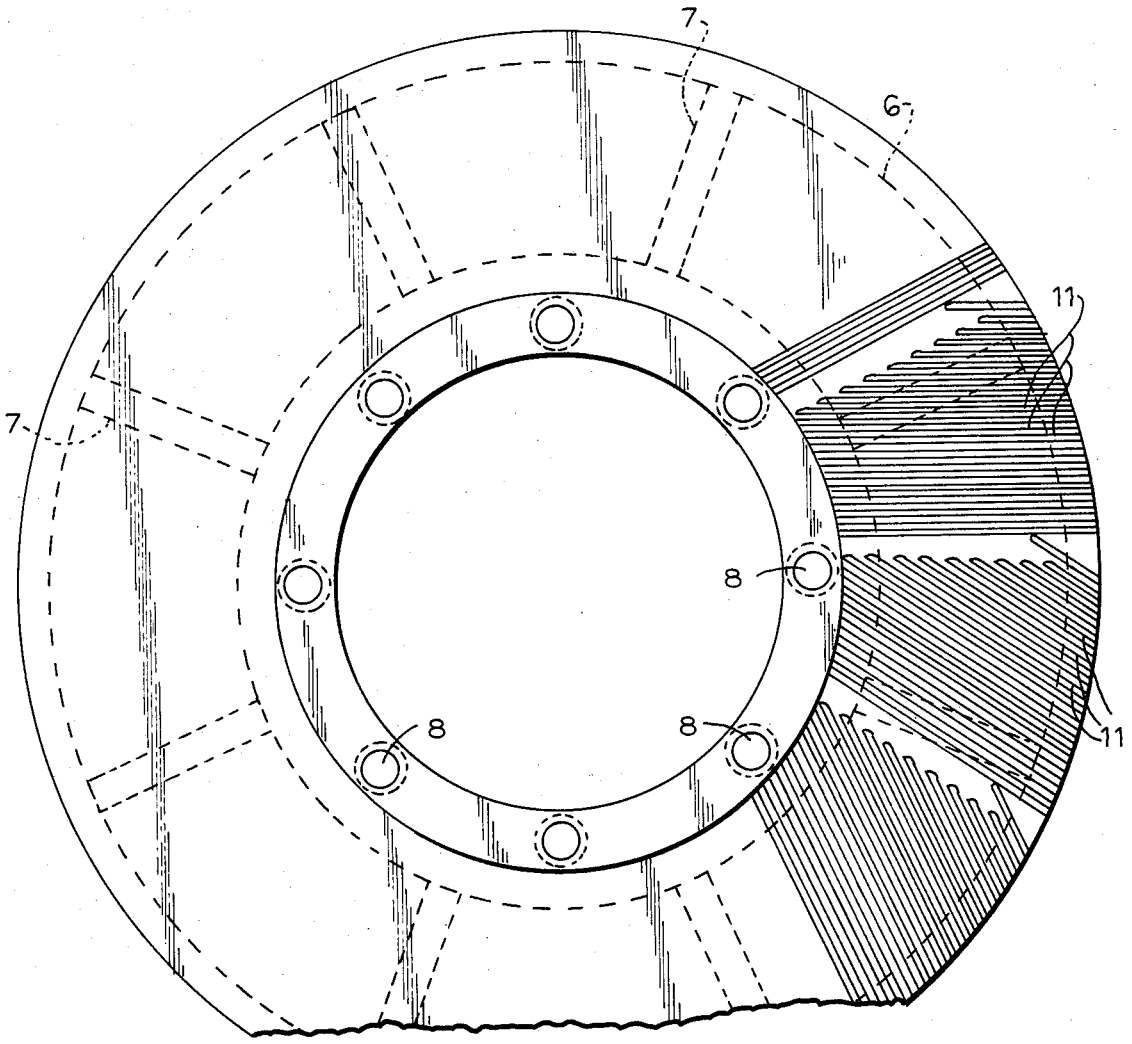
Figure 6:
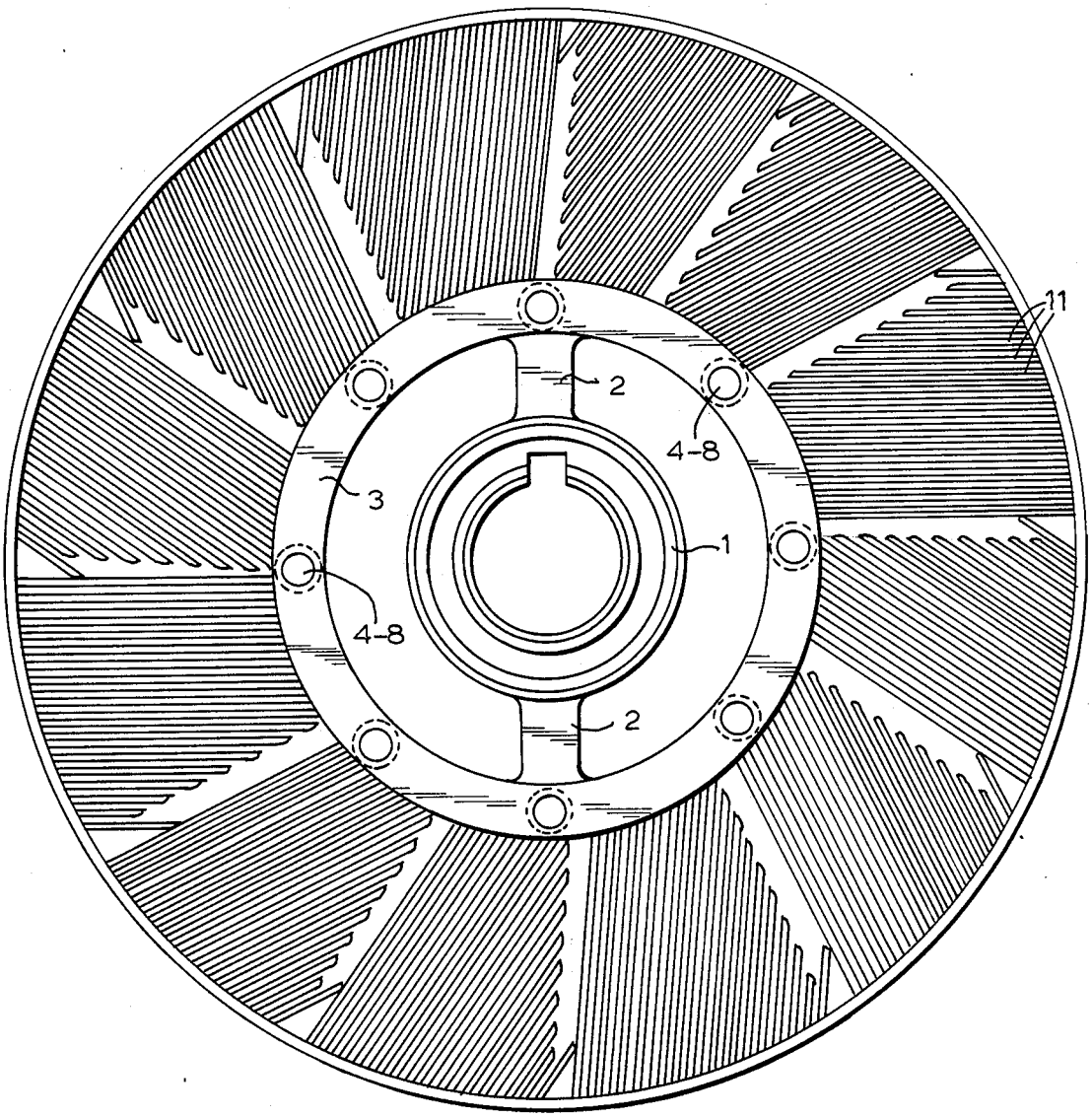
FIG. 6 is a lateral plane view of the hub-rotor disc assembly, including the subject improvements.

Such improvements are extended also to the refining disc in itself which, instead of being comprised by a single, one-piece body, like the similar former designs, will now be constructively designed in a more practical and rational manner (FIGS. 3, 4 and 5).

Therefore, according to such improvements, the refining disc is made up from a carbon-steel, iron or stainless-steel frame (FIG. 3), formed by two respectively internal 5 and external 6 concentric rings, interconnected by radial rods 7, the inner ring 5 naturally including spaced perforations 8, corresponding exactly to those of the peripheral ring 3 of hub 1, said frame receiving, on each face thereof, a plurality of trapezoidal stainless-steel plates 9, attached thereto by welding, and with the intermediate gaps likewise filled by weld beads 10 (FIG. 4), fully covering the frame, in which case such plates 9 are provided with perforations coinciding with those of the internal ring 5, or allowing the latter to be free, in whichever case however with the internal and external contours of said plates 9 being suitably machined on a lathe.

Naturally, and as a complement, both faces of the thus comprised disc receive the strictly so-called refining blades 11, in their usual arrangement, suitably attached thereto by a welding operation (FIG. 5).

Such as with the improved hub, the so-obtained refining disc also becomes far less weighty than the traditional one, with less use of material in the fabrication thereof, and naturally doing away with the weld coat between the blades.

I claim:

1. In a rotor disc assembly having a rotor disc and at least one refining disc coaxially connected thereto, the improvement comprising a central hub for mounting the rotor disc and including at least two diametrally opposing fins radially outwardly extended therefrom, and a peripheral ring formed with a plurality of uniformly circumferentially spaced perforations, said refining disc being attached to said peripheral ring at said perforations, said refining disc including a frame which includes an inner ring, an outer ring concentrically positioned with said inner ring, said inner ring being formed with perforations in correspondence with those of said peripheral ring of said hub, said inner and outer rings being connected to each other by radially extended rods and defining two end faces of the frame, said refining disc further including a plurality of stainless-steel plates of trapezoidal shape, said plates being attached to each end face of said frame by welding, said plates on each end face of said frame being spaced from each other by gaps filled with weld beads.

2. The rotor disc assembly as defined in claim 1, wherein said frame is formed of carbon-steel.

3. The rotor disc assembly as defined in claim 1, wherein said frame is formed of iron.

4. The rotor disc assembly as defined in claim 1, wherein said frame is formed of stainless steel.

5. The rotor disc assembly as defined in claim 1, wherein said plates fully cover each end face of said frame and are formed with a plurality of perforations in correspondence with those of said inner ring.

6. The rotor disc assembly as defined in claim 1, wherein said refining disc further includes refining blades attached thereto by welding.

* * * * *